US008511092B2

(12) United States Patent
Uhm et al.

(10) Patent No.: US 8,511,092 B2
(45) Date of Patent: Aug. 20, 2013

(54) DIMPLED/GROOVED FACE ON A FUEL INJECTION NOZZLE BODY FOR FLAME STABILIZATION AND RELATED METHOD

(75) Inventors: Jong Ho Uhm, Simpsonville, SC (US); Thomas Edward Johnson, Greer, SC (US); Kwanwoo Kim, Greer, SC (US); Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 524 days.

(21) Appl. No.: 12/855,801

(22) Filed: Aug. 13, 2010

(65) Prior Publication Data

US 2012/0036856 A1 Feb. 16, 2012

(51) Int. Cl.
*F02C 1/00* (2006.01)

(52) U.S. Cl.
USPC ..... 60/772; 60/737

(58) Field of Classification Search
USPC ..... 60/737, 740, 742, 772; 239/132.5, 239/419, 419.3, 419.5, 423, 424.5, 427, 427.3, 239/427.5, 428, 430, 433, 556, 557
See application file for complete search history.

(56) References Cited

U.S. PATENT DOCUMENTS

| | | | | |
|---|---|---|---|---|
| 4,100,733 | A * | 7/1978 | Striebel et al. | 60/39.463 |
| 4,967,561 | A * | 11/1990 | Bruhwiler et al. | 60/737 |
| 6,532,726 | B2 * | 3/2003 | Norster et al. | 60/39.281 |
| 7,007,478 | B2 | 3/2006 | Dinu | |
| 7,827,797 | B2 * | 11/2010 | Han et al. | 60/746 |
| 8,209,986 | B2 * | 7/2012 | Lacy et al. | 60/737 |
| 2009/0050710 | A1 * | 2/2009 | Myers et al. | 239/132.5 |
| 2012/0006030 | A1 * | 1/2012 | Uhm et al. | 60/737 |

OTHER PUBLICATIONS

U.S. Appl. No. 12/555,129, filed Sep. 8, 2009 (pending).

* cited by examiner

*Primary Examiner* — Phutthiwat Wongwian
(74) *Attorney, Agent, or Firm* — Nixon & Vanderhye, P.C.

(57) ABSTRACT

A fuel injection head for a fuel nozzle used in a gas turbine combustor includes a substantially hollow body formed with an upstream end face, a downstream end face and a peripheral wall extending therebetween. A plurality of pre-mix tubes or passages extend axially through the hollow body with inlets at the upstream end face and outlets at the downstream end face. An exterior surface of the downstream end face is formed with three-dimensional surface features that increase a total surface area of the exterior surface as compared to a substantially flat, planar downstream end face.

20 Claims, 5 Drawing Sheets

DIMPLED/GROOVED FACE ON A FUEL INJECTION NOZZLE BODY FOR FLAME STABILIZATION AND RELATED METHOD

This invention was made with Government support under contract number DE-FC26-05NT42643 awarded by the Department of Energy. Accordingly, the Government has certain rights in this invention.

This invention relates generally to gas turbine combustion technology and, more specifically, to a fuel injection head for a fuel injection nozzle optimized for high-hydrogen fuel combustion in a gas turbine.

BACKGROUND OF THE INVENTION

Certain current gas turbine fuel injection nozzles are utilized in high-hydrogen fuel combustion processes designed to lower NOx emissions. These nozzles incorporate an injection head that contains many small combustion air tubes or passages, trapped between upstream and downstream plates and surrounded by a peripheral wall, forming a hollow body serving as a fuel plenum. The tubes typically include a plurality of very small, low-angle, holes within the walls of the tubes that permit fuel from the hollow body to be injected into the interior of the tubes where the fuel and air are mixed before exiting the tubes and entering the combustion chamber. A fuel injection nozzle of this type is disclosed in commonly-owned U.S. Pat. No. 7,007,478 issued Mar. 7, 2006. Another fuel injection nozzle of this type, formed with a one-piece, monolithic injection head, is disclosed in commonly-owned co-pending application Ser. No. 12/555,129 filed Sep. 8, 2009.

High-hydrogen flame is generally stabilized behind the face of the injection nozzle body and/or dump plane area around the injection nozzle body. The dump area, however, is restricted with the number of injection nozzle heads in a full can combustor to overcome the large pressure drop through the tube bundles. As a result, only the injection nozzle head face area can be used for high-hydrogen flame stabilization. Current injection nozzle heads likewise have only limited areas for stabilizing the flame. It would therefore be desirable to develop ways to improve injection nozzle head design to further optimize high-hydrogen combustion flame stabilization, improve flashback margin and further reduce NOx emissions.

BRIEF SUMMARY OF THE INVENTION

In accordance with an exemplary but nonlimiting embodiment, the present invention relates to a fuel injection head for a fuel nozzle used in a gas turbine combustor comprising a substantially hollow body formed with an upstream end face, a downstream end face and a peripheral wall extending therebetween; a plurality of pre-mix tubes or passages extending axially through the hollow body with inlets at the upstream end face and outlets at the downstream end face; and wherein an exterior surface of the downstream end face is formed with three-dimensional surface features that increase a total surface area of the exterior surface as compared to a substantially flat, planar downstream end face.

In accordance with another exemplary but nonlimiting embodiment, the invention relates to a fuel injection head for a fuel nozzle comprising a substantially hollow body formed with an upstream end face, a downstream end face and a peripheral wall extending therebetween, a plurality of pre-mix tubes extending axially through the hollow body with inlets at the upstream end face and outlets at the downstream end face, the premix tubes each provided with plural injection holes adapted to permit fuel in the substantially hollow body to enter the premix tubes to mix with air in the premix tubes; a center opening in the upstream end face adapted to receive a fuel feed tube for supplying fuel to the substantially hollow center body; and wherein the downstream end face is provided with means for increasing surface area of the downstream end face as compared to a substantially flat, planar end face.

In still another aspect, the invention relates to a method of producing a fuel injection head that provides an enlarged recirculation patter to enhance fuel/air mixing, comprising (a) forming a substantially hollow body with an upstream end face, a downstream end face and a peripheral wall extending therebetween; (b) forming a center opening in the upstream end face adapted to receive a fuel feed tube for supplying fuel to the substantially hollow body; (c) providing a plurality of pre-mix tubes extending axially through the substantially hollow body, with inlets at the upstream end face and outlets at the downstream end face; and (d) forming the downstream end face with a pattern of three-dimensional surface features in areas between the outlets.

The invention will now be described in greater detail in connection with the drawings identified below.

DETAILED DESCRIPTION OF THE DRAWINGS

Figure 1:
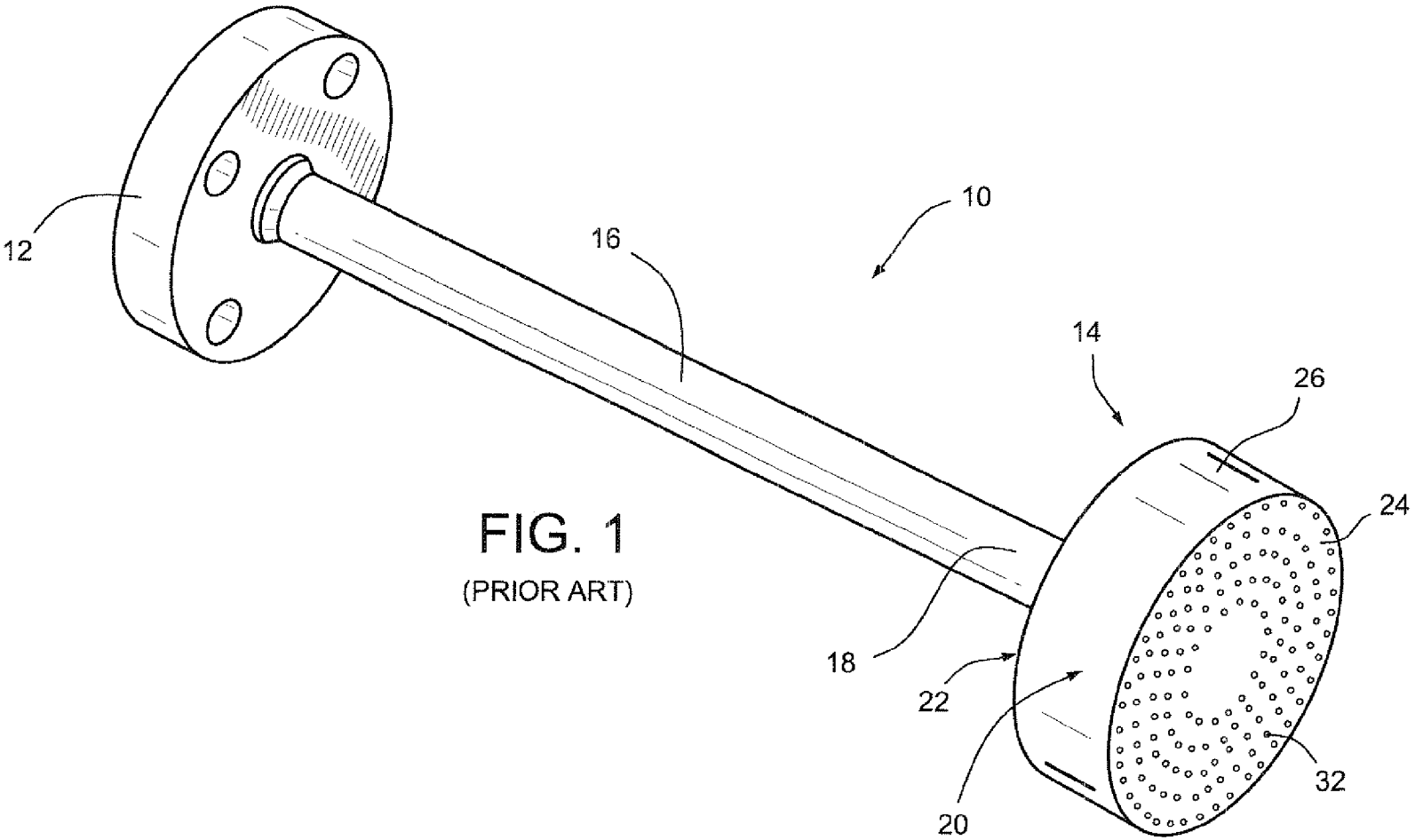
FIG. 1 (PRIOR ART)
FIG. 1 is a perspective view of a known fuel injection nozzle.

FIG. 1 shows a gas turbine fuel injection nozzle 10 which includes a fuel nozzle base 12 and a fuel injection head 14 connected by a centrally-located fuel feed tube 16. The injection nozzle head 14 is attached to the downstream end 18 of the fuel feed tube 16, with the leading edge of the fuel feed tube abutting an internal, annular shoulder (not shown) within the center of the injection nozzle head 14. Note that terms used herein such as "upstream" and "downstream" are referenced against a direction of flow of air and fuel through the fuel injector nozzle 10 and into the combustion chamber of a gas turbine combustor (not shown).

It will be appreciated that plural nozzles 10 are typically arranged to supply a mixture of fuel and air to the combustion chamber. In a known turbine configuration, an annular array of such combustors (often referred to as a "can-annular" array) supply combustion gases to a first stage of the turbine by means of a like number of transition pieces or ducts. Typically, the nozzle bases 12 in each combustor are fixed to a combustor end cover (not shown) and the fuel injection heads 14 are supported by a forward cap assembly (not shown) within the combustion chamber. The invention here is specifically concerned with design changes to the external aft (or downstream) end face configuration of the fuel injection head 14.

Figure 2:
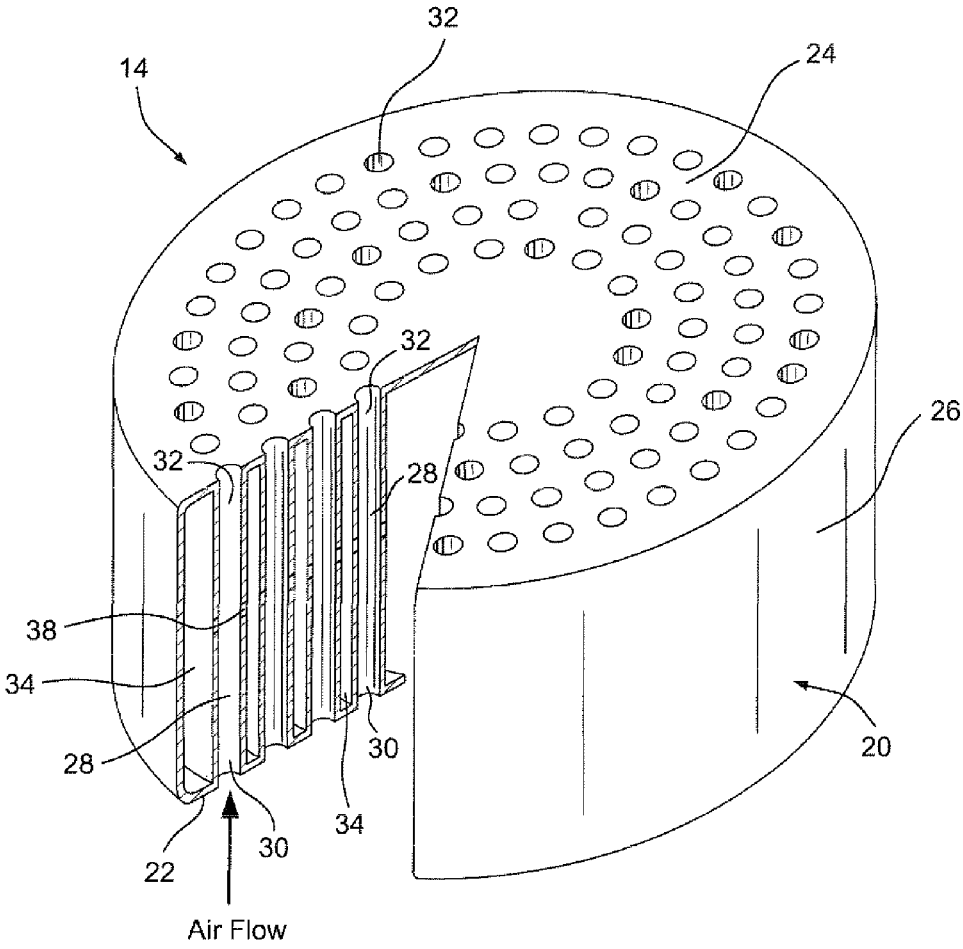
FIG. 2 (PRIOR ART)
FIG. 2 is an enlarged, partial downstream perspective view, partly sectioned, of the fuel injection head taken from FIG. 1.

With reference also to FIG. 2, the fuel injection head 14 may be formed as a substantially hollow body 20 having an upstream end face 22 and an aft or downstream end face 24, substantially parallel to one another, with an annular peripheral wall 26 axially therebetween. Internal air supply passages or tubes 28 (also referred to as pre-mix tubes) extend between the upstream and downstream end faces 22, 24 and have a substantially uniform diameter from the upstream inlets 30 through the downstream outlets 32 which are flush with the end face 24, although the inlets 30 may be flared outwardly (i.e., formed with a bell-mouth shape) to facilitate (and accelerate) the flow of air into and through the tubes. The pre-mix tubes 28 may be arranged in annular, concentric rows, with the pre-mix tubes or passages 28 of any given row circumferentially offset from the pre-mix tubes or passages of an adjacent row. It will be appreciated, however, that the invention is not limited by any specific arrangement of pre-mix tubes 28 within the hollow body 20.

The center of the hollow body 20 is open at the upstream end face 22, providing an inlet bore for receiving the fuel feed tube 16, such that fuel is supplied to the hollow body interior space 34 through which the pre-mix tubes 28 pass.

An internal baffle plate (not shown) may be formed within the hollow body 20. The baffle plate extends radially outwardly from a center portion of the hollow body 20 at a location between the upstream and downstream end faces 22, 24, respectively, with most but not all of the pre-mix tubes 28 passing therethrough. The baffle plate may be angled toward or substantially parallel to the downstream end face 24 and terminate short of the outer peripheral wall 26, leaving a radial gap between the baffle plate and the hollow body peripheral wall 26.

At least one, and preferably an array of fuel injection holes 38 is provided in each of the pre-mix tubes 28, e.g., four in each tube, at equally-spaced locations about the circumference of the respective tube. The fuel injection holes 38 lie substantially in a common plane that is parallel to the upstream and downstream end faces 22, 24 of the hollow body 20, and upstream of the internal baffle plate. The fuel injection holes 38 may be slanted in the direction of flow, i.e., the holes may be angled radially inwardly (at low acute angles, for example 15°, relative to the centerline of the respective pre-mix tube 28) in the downstream direction so that the flow of fuel through the injection holes 38 has a velocity component in the direction of the air flowing through the pre-mix tubes 28. It will be understood, however, that the injection holes 38 may extend at any angle between 15° and substantially 90° relative to the longitudinal axes of the pre-mix tubes 28. The internal baffle plate effectively divides the hollow body 20 into upstream and downstream plenums, connected by the radial gap between the outer end of the baffle plate and the hollow body peripheral wall 26.

Except for the outlets 32 to the premix tubes 28, the downstream or aft end face 24 of the fuel injection head 14 is closed so that high-pressure hydrogen fuel exiting the fuel feed tube 16 will flow into the areas 34 between the pre-mix tubes 28 in the downstream fuel plenum and then reverse flow through the radial gap into the upstream plenum. This fuel path tends to equalize the fuel pressure at the inlet ends of the fuel injection holes 38 and thus distributes the fuel substantially uniformly to the pre-mix tubes 28. The high-hydrogen fuel will flow through the fuel injection holes 38 and into the pre-mix tubes 28 where the fuel and air will mix before exiting the fuel injection head 14 at the aft end face 24 into the combustion chamber.

Figure 3:
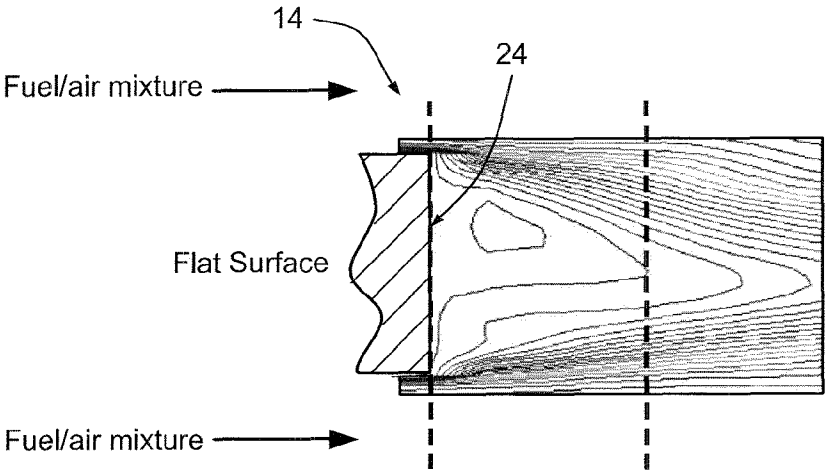
FIG. 3 (PRIOR ART)
FIG. 3 shows a flat end face portion of the fuel injection head construction of FIG. 2, illustrating flame recirculation characteristics.
Figure 4:
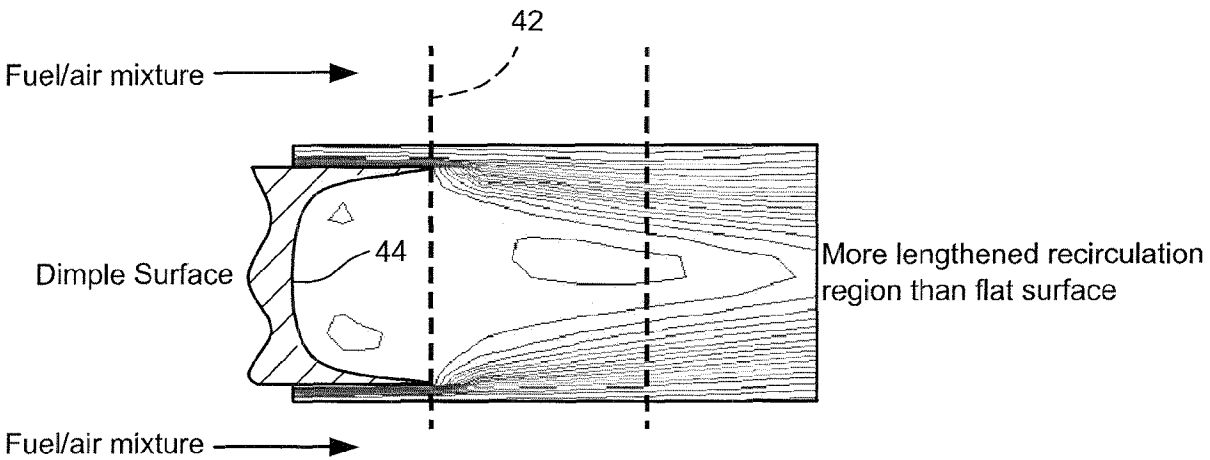
FIG. 4 shows a redesigned end face portion of a fuel injection head illustrating flame recirculation characteristics in accordance with the exemplary embodiment of the invention.

It has been found that by increasing the surface area of the end face 24 of the fuel injection head 14, fuel/air mixing and flame stabilization can be enhanced and flame holding and flashback inside the tubes can be avoided, particularly for high-hydrogen combustion. FIG. 3 illustrates the flame recirculation characteristics of the current fuel injection head design as described hereinabove and as shown in FIG. 2. FIG. 4 illustrates the flame recirculation characteristics of a fuel injection head in accordance with a first exemplary but non-limiting embodiment of this invention. As will be described in greater detail below, the end face of the fuel injection head has been formed to include three-dimensional surface concavities (one shown at 44) that provide an enlarged or lengthened recirculation pattern that enhances the fuel/air mixing, and provides a greater flashback margin, thereby avoiding flame holding and flashback within the premix tubes 46. As a result of the improved flame stabilization and flashback margin, NOx emissions are also reduced.

In each arrangement described below, the fuel injection head end face area has been increased relative to a substantially-flat planar end face without surface concavities with resultant widening and lengthening of the recirculation region caused by aerodynamically stable vortices, as can be seen from a comparison of FIGS. 3 and 4.

Figure 5:
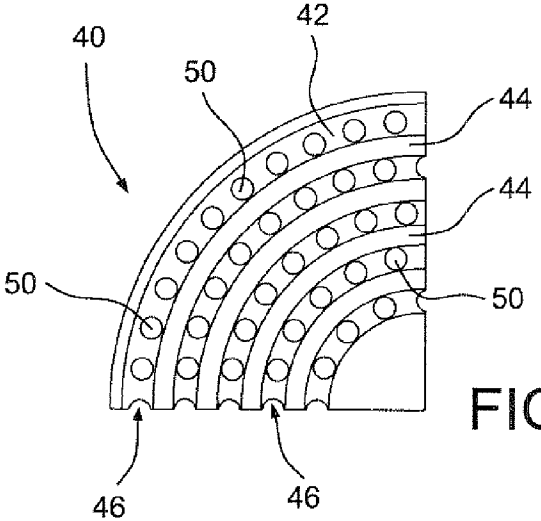
FIG. 5 is a partial end elevation of a fuel injection head with surface features in accordance with an exemplary but nonlimiting embodiment of the invention.

It will be appreciated that there are a variety of ways to increase the surface area of the end face 42 of the fuel injection head 40. For example, as shown in FIGS. 4 and 5, the aft end face 42 of the fuel injection head 40 may be formed with a series of concavities 44 in the form of annular, circumferential grooves located radially between adjacent annular rows 46 of outlets 50 of the premix tubes 46. The depth and width of the grooves 44 may vary depending on specific applications.

Figure 6:
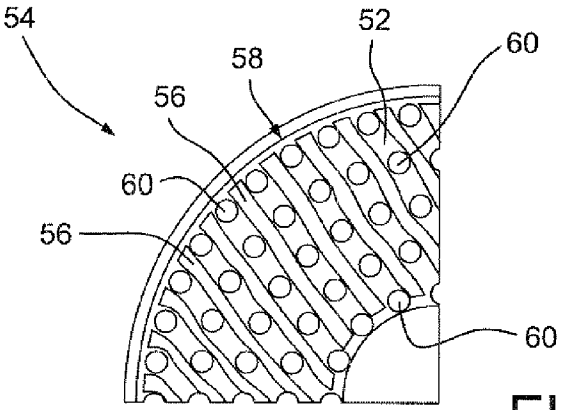
FIG. 6 is a partial end elevation of a fuel injection head with surface features in accordance with another exemplary but nonlimiting embodiment of the invention.

In FIG. 6, the surface area of the aft end face 52 of the fuel injection head 54 is formed with a series of substantially radially extending grooves 56 located circumferentially between adjacent substantially radial rows 58 of outlets of the premix tubes 60.

Figure 7:
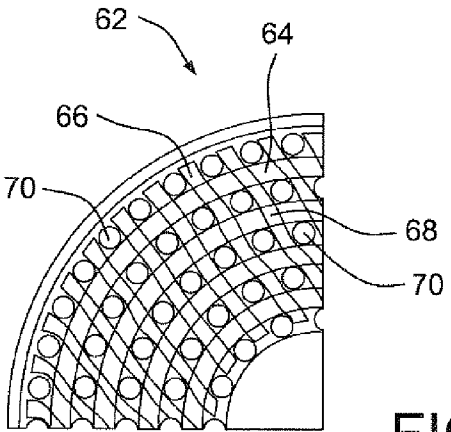
FIG. 7 is a partial end elevation of a fuel injection head illustrating a combination of the surface features shown in FIGS. 5 and 6.

In FIG. 7, the fuel injection head 62 is formed with annular grooves 64 (similar to grooves 56), combined with substantially radial grooves 66, to form a grid pattern with intersections 68 formed centrally of each group of four outlets to the premix tubes 70.

Figure 8:
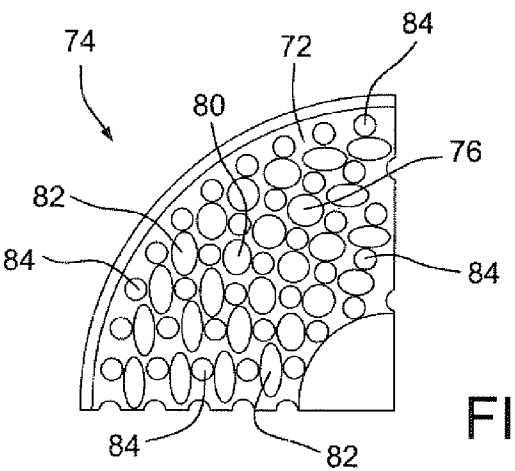
FIG. 8 is a partial end elevation of a fuel injection head with surface features in accordance with yet another exemplary but nonlimiting embodiment of the invention.

FIG. 8 illustrates a pattern of dimples formed on the aft end face 72 of the fuel injection head 74. The dimples may have various shapes including round dimples 76, oval dimples 80, elongated oval dimples 82, etc. The dimples on the injection nozzle head 74 may have an array of one of these shapes or any combination of two or more such shapes, and in any desired pattern about the end face 72 in areas between the outlets to the premix tubes 84.

The width of the annular and radial grooves, the diameter of the dimples, and the depth of both the grooves and dimples will likely be in the range of from about 0.1 to 1.5 times the diameter of the premix tubes or passages.

Figure 9:
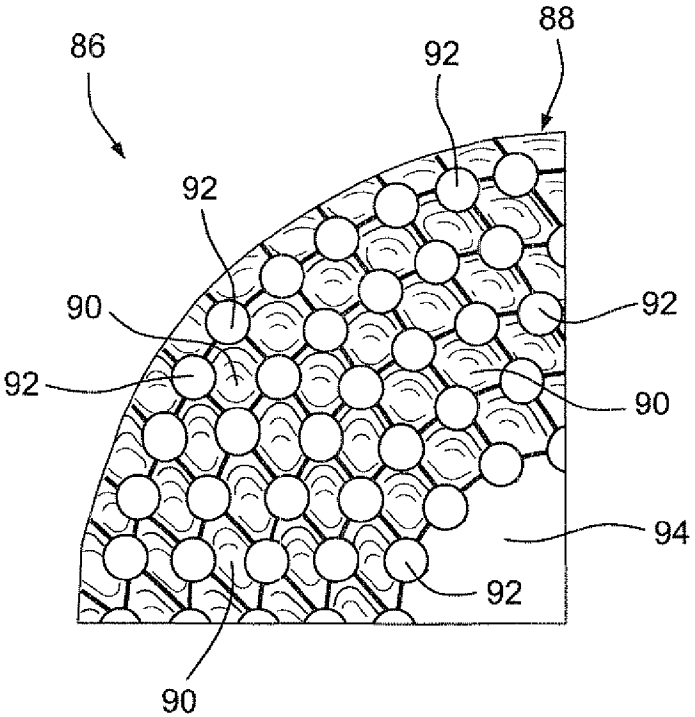
FIG. 9 is a partial end elevation of a fuel injection head with surface features in accordance with yet another exemplary but nonlimiting embodiment of the invention.

FIG. 9 illustrates yet another example embodiment of a fuel injection head 86 where the end face 88 is formed with concavities in the form of irregularly-shaped dimples 90 in areas between each group of four surrounding outlets to the premix tubes or passages 92. Thus, the dimples 90 have boundaries connecting the four surrounding premix tubes or passages, forming a lattice or grid-like pattern of dimples that effectively occupy the entire surface of the end face 88, with the exception of a closed center region 94 also devoid of premix tubes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel injection head for a fuel nozzle used in a gas turbine combustor comprising:

a substantially hollow body formed with an upstream end face, a downstream end face and a peripheral wall extending therebetween;

a plurality of pre-mix tubes or passages extending axially through said hollow body with inlets at said upstream end face and outlets flush with an exterior surface of said downstream end face; and wherein said exterior surface of said downstream end face is formed with at least one of a plurality of dimples and a plurality of grooves that increase a total surface area of said exterior surface of said downstream end face to provide an enlarged recirculation pattern that enhances fuel/air mixing as compared to a substantially flat, planar downstream end face.

2. The fuel injection head of claim 1 further comprising a center opening in the upstream end face adapted to receive a fuel feed tube for supplying fuel to said substantially hollow body; and wherein fuel injection holes are provided in each of said pre-mix tubes or passages thereby enabling fuel in said substantially hollow body to be injected into said plurality of pre-mix tubes or passages.

3. The fuel injection head of claim 1 wherein said plurality of pre-mix tubes or passages are arranged in concentric annular rows, with pre-mix tubes or passages in one row circumferentially offset from pre-mix tubes or passages in an adjacent row.

4. The fuel injection head of claim 1 wherein said exterior surface of said downstream end face is formed with a plurality of substantially concave dimples.

5. The fuel injection head of claim 1 wherein said exterior surface of said downstream end face is formed with a plurality of substantially concentric, annular grooves.

6. The fuel injection head of claim 1 wherein said exterior surface of said downstream end face is formed with a plurality of substantially radially-oriented grooves.

7. The fuel injection head of claim 5 wherein said exterior surface of said downstream end face further comprises a plurality of substantially radially-oriented grooves that intersect said plurality of concentric annular grooves.

8. The fuel injection head of claim 4 wherein said plurality of substantially concave dimples have round or oval shapes.

9. The fuel injection head of claim 4 wherein said plurality of substantially concave dimples are arranged in a lattice or grid-like pattern, substantially filling an entire space between a group of four surrounding premix tubes or passages.

10. The fuel injection head of claim 4 wherein said plurality of substantially concave dimples have different cross sectional shapes.

11. The fuel injection head of claim 10 wherein said plurality of concave dimples include at least round and oval shapes.

12. The fuel injection head of claim 1 wherein a width dimension of the annular and radial grooves, a diameter of the dimples, and a depth dimension of the grooves and the dimples lie in a range of from 0.1 to 1.5 times a diameter of the premix tubes or passages.

13. A fuel injection head for a fuel nozzle comprising:

a substantially hollow body formed with an upstream end face, a downstream end face and a peripheral wall extending therebetween, a plurality of pre-mix tubes extending axially through said hollow body with inlets at said upstream end face and outlets flush with said downstream end face, said premix tubes each provided with plural injection holes adapted to permit fuel in said substantially hollow body to enter said premix tubes to mix with air in said premix tubes;

a center opening in the upstream end face adapted to receive a fuel feed tube for supplying fuel to said substantially hollow center body; and wherein an exterior surface of said downstream end face is provided with a plurality of dimples or grooves to thereby increase the surface area of said downstream end face.

14. The fuel injection head of claim 13 wherein said downstream end face is formed with a plurality of substantially concave dimples.

15. The fuel injection head of claim 13 wherein said downstream end face is formed with a plurality of substantially concentric, annular grooves.

16. The fuel injection head of claim 13 wherein said downstream end face is formed with a plurality of substantially radially-oriented grooves.

17. The fuel injection head of claim 15 wherein said downstream end face is formed with a plurality of substantially radially-oriented grooves that intersect said concentric annular grooves.

18. The fuel injection head of claim 14 wherein said plurality of substantially concave dimples are round or oval in shape.

19. The fuel injection head of claim 14 wherein said plurality of substantially concave dimples are arranged in a lattice or grid-like pattern substantially filling an entire space between a group of four surrounding premix tubes or passages.

20. A method of producing a fuel injection head that provides an enlarged recirculation pattern to enhance fuel/air mixing, comprising:

a) forming a substantially hollow body with an upstream end face, a downstream end face and a peripheral wall extending therebetween;

(b) forming a center opening in the upstream end face adapted to receive a fuel feed tube for supplying fuel to said substantially hollow body;

(c) providing a plurality of pre-mix tubes or passages extending axially through said substantially hollow body, with inlets at said upstream end face and outlets substantially flush with said downstream end face; and (d) forming said downstream end face with a pattern of three-dimensional surface features in areas between said outlets to thereby increase surface area of said downstream end face.

* * * * *